US005295721A

United States Patent [19]

Wu

[11] Patent Number: 5,295,721

[45] Date of Patent: Mar. 22, 1994

[54] ANIMAL WASTE PICK-UP APPARATUS

[76] Inventor: Simon F. Wu, 3006 Blandford Dr., Rowland Heights, Calif. 91748

[21] Appl. No.: 65,841

[22] Filed: May 21, 1993

[51] Int. Cl.[5] ..... A01K 29/00; E01H 1/12

[52] U.S. Cl. ..... 294/1.4; 15/257.6

[58] Field of Search ..... 294/1.3–1.5, 294/19.1, 25, 50.8, 50.9, 53.5, 55; 15/104.8, 257.1, 257.4, 257.6, 257.7

[56] References Cited

U.S. PATENT DOCUMENTS

| | | | |
|---|---|---|---|
| 3,052,214 | 9/1962 | Johnson | 294/1.4 |
| 3,446,525 | 5/1992 | Jones | 294/1.4 |
| 3,733,098 | 5/1973 | Tobias | 294/1.4 |
| 3,739,418 | 6/1973 | Yonaites et al. | 294/1.3 |
| 3,767,247 | 10/1973 | Wetzler | 294/1.3 |
| 3,806,984 | 4/1974 | Hilsabeck | 294/1.3 |
| 3,929,363 | 12/1975 | Kahan | 294/1.4 |
| 4,097,082 | 6/1978 | Orofino | 294/1.4 |
| 4,210,351 | 7/1978 | Orofino | 294/1.4 |
| 4,247,139 | 1/1981 | Grieb | 294/1.4 |
| 4,323,272 | 4/1982 | Fortier | 294/1.4 |
| 4,747,633 | 5/1988 | Stacy | 294/1.3 |
| 4,948,266 | 8/1990 | Bencic | 294/1.3 X |

FOREIGN PATENT DOCUMENTS

| | | | |
|---|---|---|---|
| 37355 | 10/1981 | European Pat. Off. | 294/1.3 |
| 3423339 | 7/1985 | Fed. Rep. of Germany | 294/1.3 |
| 7713350 | 9/1979 | Netherlands | 294/1.5 |
| 2032831 | 5/1980 | United Kingdom | 294/1.3 |

*Primary Examiner*—Johnny D. Cherry
*Attorney, Agent, or Firm*—Sheldon & Mak

[57] ABSTRACT

An apparatus for handling waste such as animal feces to be removed from a ground surface includes an actuator unit and a disposable receptacle. The receptacle includes a jaw portion having hinged jaw members, lower extremities thereof forming respective blade portions, one of the jaw members being movable relative to the other jaw member between an open position for receiving the waste into the receptacle, and a closed position, each of the jaw members having an engagement member for actuation by the actuator unit. A bag of the receptacle is sealingly connected to the jaw portion for holding the waste material in a bag cavity that joins the jaw cavity proximate a partition member that retains the waste in the bag and separate from the jaw cavity, a jaw holder yieldably holding the jaw members in the closed position. The actuator unit includes a handle, a pair of actuator members for supportively connecting the engagement members of the receptacle, and a first actuator for operating the jaw members between the open and closed positions, and a second actuator for tilting the receptacle for moving the waste from the jaw cavity into the bag. The apparatus is operable for positioning the receptacle in contact with the ground surface with the blade members on opposite sides of the waste material by manipulation of the handle and the first actuator; moving the jaw members into the closed position; tilting the receptacle whereby waste material is confined within the bag for permitting multiple pick-ups using a single receptacle; and disconnecting the receptacle from the actuator unit for convenient and sanitary disposal of the waste together with the receptacle.

26 Claims, 2 Drawing Sheets

ANIMAL WASTE PICK-UP APPARATUS

BACKGROUND

The present invention relates to pickup devices, and more particularly to devices for the sanitary disposal of animal excrement and the like.

Numerous devices have been used for clearing animal excrement from fouled surfaces, including a long-handled scoop implement that is used in combination with a long-handled scraper. Other devices of the prior art include implements that load disposable bags and implements that load disposable receptacles. Implements that load disposable receptacles are disclosed in U.S. Pat. Nos. 3,929,363 to Kahan and 4,247,139 to Grieb. These devices are typically subject to the following disadvantages:

1. They are expensive to produce, being relatively complex;
2. They are likely to become contaminated with waste, subjecting users to contact with the contamination when loading receptacles subsequent to the contamination; and
3. They are ineffective for multiple pick-ups into a single receptacle, because the receptacle is latched closed as the waste is being received therein.

Implements that load disposable bags are disclosed in U.S. Pat. Nos. 3,446,525 to Jones, 4,210,351 to Orofino, and 4,323,272 to Portier. While affording some advantages over the devices having disposable receptacles, these devices are nevertheless subject to one or more of the following disadvantages:

1. They are difficult to use in that the bag is difficult to install on the device;
2. They are ineffective in that the bag is not reliably closed following pick-up, and exposed surfaces of the bag are likely to be contaminated by contact with the ground;
3. While in some cases it is possible to make multiple pick-ups into a single bag, it is done with considerable difficulty and uncertainty; and
4. The device is complex and expensive to produce in that it must support a bag that provides no support apart from permanent portions of the device.

Thus, there is a need for a pickup device that overcomes the above disadvantages.

SUMMARY

The present invention meets this need by providing a waste pick-up apparatus having a disposable bag receptacle unit that is reinforced with structural members. In one aspect of the invention, the apparatus includes an actuator unit and a disposable receptacle unit. The receptacle unit includes a jaw portion having first and second jaw members, lower extremities of the respective jaw members forming corresponding generally horizontally extending first and second blade portions, one of the jaw members being movable relative to the other jaw member between an open position wherein the jaw members are separated by a jaw opening for receiving the waste material into the receptacle unit, and a closed position wherein the jaw members are in close proximity for forming a jaw cavity, each of the jaw members having an engagement member for actuation by the actuator unit. A flexible bag member of the receptacle is sealingly connected to the jaw portion for holding the waste material in a bag cavity that joins the jaw cavity whereby the bag cavity is substantially closed by the jaw members in the closed position thereof for retaining the waste material within the receptacle unit, a jaw holder yieldably holding the jaw members in the closed position. The actuator unit includes a base handle member, a spaced pair of actuator members for supportively connecting the engagement members of the receptacle unit, and a first actuator for operating the jaw members between the open and closed positions. The apparatus is operable for positioning the receptacle unit in substantial contact with the ground surface with the blade members on opposite sides of the waste material by manipulation of the base handle member and the first actuator; moving the jaw members into the closed position whereby waste material is contained within the receptacle unit; and disconnecting the receptacle unit from the actuator unit for convenient and sanitary disposal of the waste together with the receptacle unit.

Each of the actuator members can have a horizontally projecting leg portion, the engagement members of the jaw portion each forming a socket opening for receiving a respective one of the leg portions. The actuator members can be pivotally connected relative to the base handle member. Preferably, the apparatus further includes an actuator holder for biasingly urging the actuator members toward the closed position of the jaw members for securely and automatically closing the receptacle unit when waste pick-ups are made, and for facilitating engagement of the actuator members with the engagement members of a fresh receptacle unit. The actuator holder can include an elastic band enclosing portions of the actuator members. The socket openings can extend proximate the blade members, approximately in parallel relation thereto.

Preferably, the receptacle unit further includes a hinge member for hingably connecting the jaw members, the hinge member further contributing to the structural integrity of the jaw portion. The first actuator can include a first handle member movably supported relative to the base handle member; and a first connector operatively connecting the first handle member to one of the actuator members for movement thereof, the receptacle unit being opened in response to movement of the first handle relative to the base handle. The first handle member can slidably engage the base handle member, and the first connector can include a flexible member.

In an important and preferred aspect of the invention, the apparatus further includes a second actuator for orienting the jaw cavity above the bag cavity for facilitating transfer of the waste material into the bag cavity from the jaw cavity, and a blocker for blocking the waste material from reentering the jaw cavity. Thus, the apparatus is further operative for picking up an additional quantity of waste material without losing waste material previously transferred into the bag cavity. The second actuator is preferably operative for moving the engagement members from an approximately horizontally spaced orientation to an approximately vertically spaced orientation while the jaw members remain in the closed position, thereby tipping the receptacle unit so that the waste material can roll or fall into the bag cavity. The actuator members can be pivotally connected relative to the base handle member, and the second actuator can be operative for selectively moving one of the jaw members in a direction displacing the other jaw member. The second actuator can include a second handle member movably supported relative to the base handle member between a lock position and a transfer position; a second connector operatively connecting the second handle member to one of the actuator members for movement thereof, the engagement members of the receptacle unit being moved to the vertically spaced orientation in response to movement of the second handle relative to the base handle; and a lock for yieldably holding the second handle member in the lock position wherein the actuator members are releasably maintained in the horizontally spaced orientation.

The blocker can include a partition member of the jaw portion that defines a transfer opening between the jaw cavity and the bag cavity. The partition member can form a side wall of one of the jaw members. The bag connector can include an adhesive strip. The bag member preferably is formed of a transparent material for monitoring operation of the apparatus.

The jaw holder can include an elastic band extending between the jaw members. The elastic band of the jaw holder can be retained by the engagement members of the receptacle unit. The elastic band of the jaw holder can extend proximate opposite ends of the jaw members.

In another aspect of the invention, the apparatus includes the jaw portion having first and second jaw members, the hinge member for hingably connecting the jaw members, the flexible bag member for holding the waste material, the bag connector for sealingly connecting the bag member to the jaw portion, the jaw holder for yieldably holding the jaw members in the closed position and the blocker for blocking the waste material from reentering the jaw cavity. Thus, the apparatus is operative for positioning the receptacle unit in substantial contact with the ground surface with the blade members on opposite sides of the waste material by manipulation of the base handle member while the jaw members are in the open position; moving the jaw members into the closed position whereby waste material is contained within the receptacle unit, the jaw members being maintained in the closed position by the jaw holder for retaining the waste material within the apparatus for disposal therewith; and picking up an additional quantity of waste material without losing waste material previously transferred into the bag cavity.

Preferably/ the engagement members of the jaw portion each form a socket opening for receiving actuator leg members. The socket openings can extend proximate the blade members, approximately in parallel relation thereto.

DRAWINGS

These and other features, aspects, and advantages of the present invention will become better understood with reference to the following description, appended claims, and accompanying drawings, where:

DESCRIPTION

Figures 1, 2, 3:
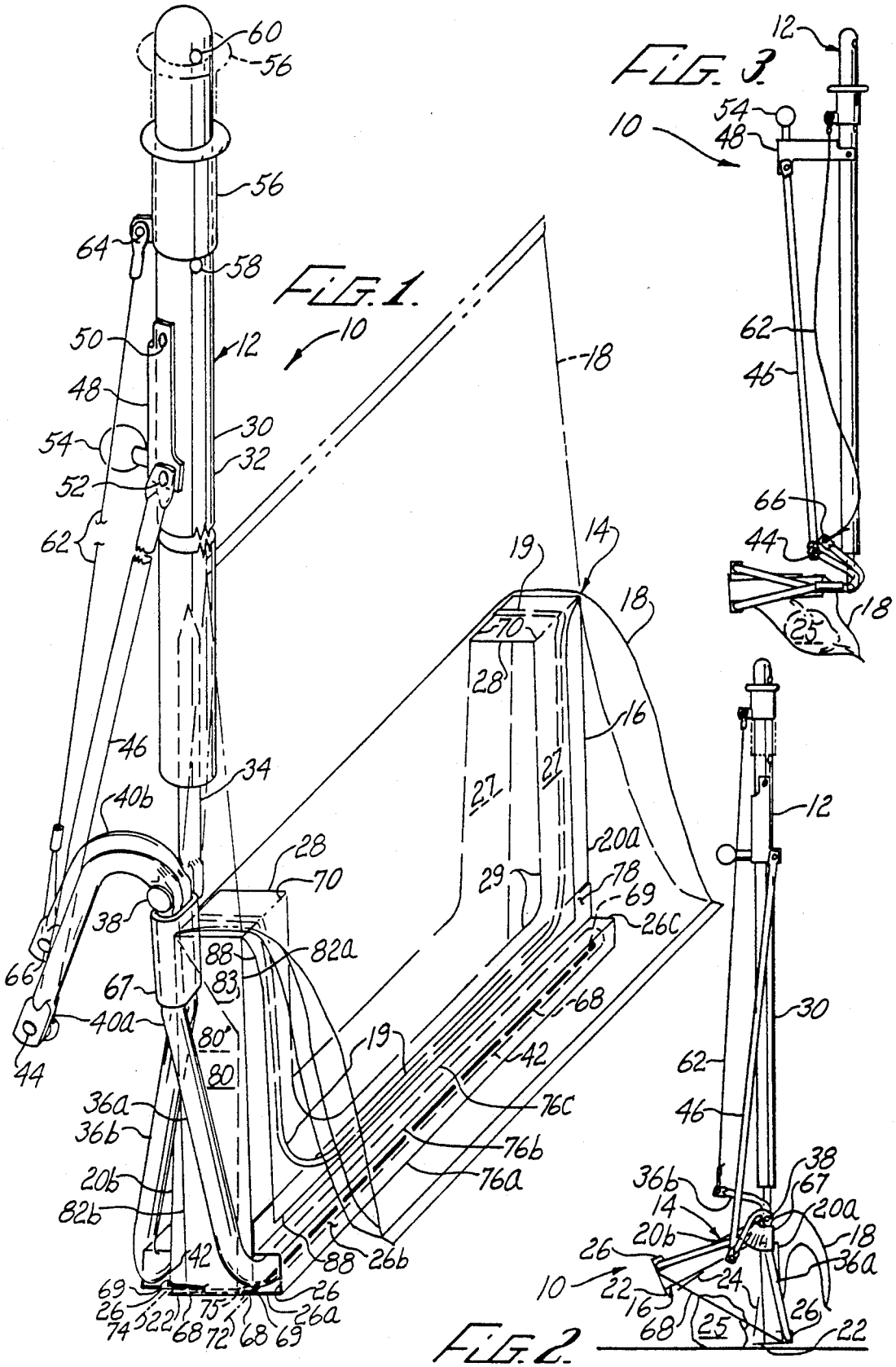
FIG. 1 is an oblique elevational perspective view of a waste pick-up apparatus incorporating features of the present invention.
FIG. 2 is an end elevational view of the apparatus of FIG. 1 in use receiving waste.
FIG. 3 is an end elevational view as in FIG. 2, showing the apparatus in a folded condition for transfer of the waste.

The present invention is directed to a waste pick-up device that is easy to use, inexpensive to provide, and effective for making multiple pick-ups into a single disposable container, which is self-enclosing upon disposal. With reference to FIG. 1 of the drawings, a collection apparatus 10 according to the present invention includes an actuator unit 12 and a disposable receptacle unit 14, the receptacle unit 14 having an openable jaw portion 16 and a flexible bag portion 18, the jaw portion 16 providing structural support for the bag portion 18 and being sealingly connected thereto along an adhesive strip 19.

In an exemplary configuration of the apparatus 10, the jaw portion 16 of the receptacle unit 14 is formed of a relatively stiff sheet material, such as card stock, the material being suitably folded for forming structural features as described herein. In particular, the jaw portion 16 has a first jaw member **20*a* and a second jaw member 20*b*, each of the jaw members 20*a* and 20*b* having a blade portion 22, the blade portions 22 being generally horizontally disposed in the orientation of the receptacle unit 14 as shown in FIG. 1. The blade portions 22 are separable for forming a jaw opening 24 in use of the apparatus 10 as shown in FIG. 2 wherein the apparatus 10 is positioned for receiving a body of waste 25, such as animal feces, into the jaw portion 16 through the jaw opening 24**.

The jaw portion 16 is formed to include a pair of actuator sockets 26 for actuation of the receptacle unit 14 by the actuator unit 12 as described below. The jaw portion 16 also includes a spaced pair of hinge members 28, the hinge members 28 pivotally connecting the jaw members **20*a* and 20*b* at locations spaced above the blade portions 22 for supporting the jaw members 2*a* and 2*b* in alignment during operation thereof. Further, side portions 27 of the jaw members 2*a* and 2*b* have U-shaped side openings 29 between the hinge members 28 for facilitating transfer of the waste 25 from the jaw portion 16 to the bag portion 18 as described further in connection with FIG. 3**.

The actuator unit includes a main handle 30 having an elongate shank member 32 for holding by a user of the apparatus 10, and a stem member 34 that forms a bottom extremity of the handle 30, the stem member 34 being of reduced outside diameter and rigidly coaxially joined to the shank member 32. The main handle 30, being normally held vertically oriented by the user, functions as a support base of the apparatus 10. A pair of actuator cranks, designated first crank **36*a* and second crank 36*b*, are pivotally connected to the stem member 34 at a pivot 38 for supportively manipulating the receptacle unit 14, the cranks 36*a* and 36*b* having respective arm portions 40*a* and 40*b* that move generally in a vertical plane, and leg portions 42 that extend generally horizontally from bottom extremities of the arm portions 40*a* and 40*b* for axially engaging corresponding ones of the sockets 26 of the receptacle unit 14**.

The first arm portion **40*a* extends upwardly from the pivot 38, curving laterally and downwardly to a first journal extremity 44, a rigid connecting rod 46 being pivotally connected between the journal extremity 44 and a tipping lever 48 for moving the first crank 36*a* between a generally upright first position as shown in FIGS. 1 and 2 and a tipped second position as shown in FIG. 3. The tipping lever 48 is pivotally connected at a lever pivot 50 to the shank member 32 of the main handle 30, a lever journal 52 of the tipping lever 48 pivotally connecting the connecting rod 46, preferably so that when the tipping lever 48 is positioned against the shank member 52 as shown in FIGS. 1 and 2, the first crank 36***a* is releasably locked in its first position by over-center alignment of the lever journal 52 relative to the first journal extremity 44 and the lever pivot 50. A tipping knob 54 rigidly extends from the tipping lever 48 for manual operation of the first crank 36*a* from the first position to the second position as shown in FIG. 3 when it is desired to shift the contents of the receptacle unit 14 from the jaw portion 16 to the bag portion 18.

In normal use as described herein, shifting of the waste 25 into the bag portion 18 is caused by the movement of the first crank 36*a* to its second position; however, a slight shaking or reciprocal movement of the apparatus 10 is likely to dislodge waste 25 that happens to be retained within the jaw portion 16 for more completely effecting the shifting. Residual waste 25 that remains stuck within the jaw portion 16 following the shifting as described above is unlikely to interfere with subsequent pick-ups of additional waste 25 because the residual waste 25 is not likely to be dislodged from the jaw portion 16 by merely opening the receptacle unit 14 in the absence of further shaking and/or reciprocal motion of the apparatus 10.

The actuator unit 12 also includes a jaw opening handle 56 that slidably engages the shank member 32 between a close stop 58 and an open stop 60, the stops 58 and 60 rigidly projecting from the shank member 32. An actuator cable 62 is connected between an opening journal 64 of the handle 56 and a second crank journal 66 of the second crank 36*b* for opening the receptacle unit 14 in response to upward movement of the opening handle 56. A first elastic band 67 tightly surrounds portions of the arm portions 40*a* and 40*b* that extend in generally parallel adjacent relation below the pivot 38 when the receptacle unit 14 is closed as shown in FIG. 1, the first elastic band 67 being distended when the receptacle unit is open as shown in FIG. 2. When it is desired to close the receptacle unit 14, the opening handle 56 is allowed to move downwardly along the shank member 32, thereby slackening the actuator cable 62, the actuator crank 36*b* being consequently restored to the position of FIG. 1 by the first elastic band 67. The actuator cable 62 can be made from a cord of flexible material such as nylon having loops or other suitable connector elements formed at extremities thereof. Apart from the actuator unit 12, the jaw members 20*a* and 20*b* are biasingly retained in the closed position by a second elastic band 68, the band 68 extending through the sockets 26 and being located by a plurality of notches 69 as shown in FIG. 1. The second elastic band 68 stretches across the jaw opening 24 when the receptacle unit 14 is open as shown in FIG. 2.

Figure 4:
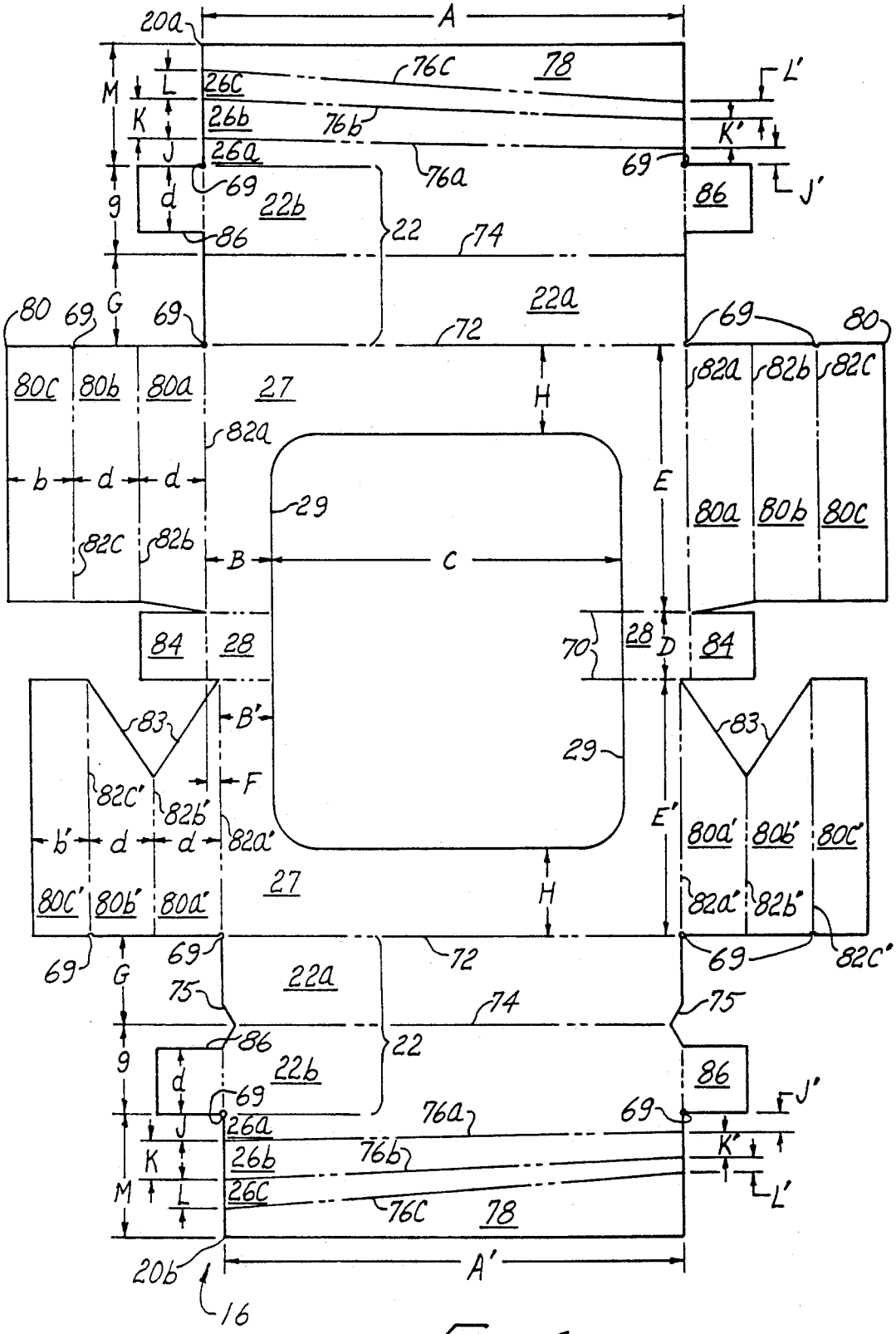
FIG. 4 is a flat pattern view of a jaw portion of the apparatus of FIG. 1.

As discussed above, the jaw portion 16 of the receptacle unit 14 can be formed of sheet material such as card stock or a thin plastic material. An exemplary flat pattern layout of the jaw portion 16 is presented in FIG. 4 for fabrication from any suitable material that is semi-rigid and flexibly foldable. As shown in FIG. 4, the first jaw member 20*a* of the jaw portion 16 has a width A in the longitudinal direction of the sockets 26, the second jaw member 20*b* having a slightly reduced width A' for permitting the blade portion 22 of the second jaw member to close within the first jaw member, the U-shaped side opening 29 of the jaw members 20*a* and 20*b* being offset a distance B from the width A and having a width C within which the waste 25 passes from the jaw portion 16 to the bag portion 18 as described above. The hinge member 28 has a width D between the jaw members 20*a* and 20*b*, being joined thereto along a pair of hinge fold lines 70 that extend, respectively, at a distance E from the blade portion 22 of the first jaw member 20*a* and a distance E' from the blade portion 22 of the second jaw member 20*b*, the distance E' being slightly less than the distance E for facilitating entry of the blade portion 22 of the second jaw member 20*b* within the first jaw member 20*a*. Lateral extremities of the second jaw member 20*b* are offset from corresponding extremities of the first jaw member 20*a* by an offset F, the offset F being preferably approximately half of the difference between the widths A and A'.

Each of the blade portions 22 has a width G in a direction approximately orthogonal to the width A and the distance E, top layers 22*a* of the blade portions 22 being joined to the corresponding side portions 27 along respective blade fold lines 72, the blade portions 22 being reinforced by being folded double along respective edge fold lines 74, the material of the jaw portion 16 being notched as indicated at 75 for further facilitating entry of the blade portion 22 of the second jaw member 20*b* into the first jaw member 20*a*. From each edge fold line 74, the material of the jaw portion 16 projects a distance g that corresponds to the width G of the blade portion 22, forming an outside layer 22*b* thereof, the material further extending a distance J outwardly from the side portion 27 to a first socket fold line 76*a* for forming a bottom wall 26*a* of each socket 26. The notches 69 for locating the second elastic band 68 are formed at opposite extremities of the blade fold lines 72, and at corresponding locations on the jaw members 20*a* and 20*b* as shown in FIG. 4.

From the first socket fold line 76*a*, a side socket wall 26*b* extends a distance K upwardly to a second socket fold line 76*b*, from which a top socket wall 26*c* extends a distance L approximately horizontally toward the respective side portion 27 to a third socket fold line 76*c*, a socket tab 78 extending upwardly from the third fold line 76*c* along the side portion 27. The socket tab 78 is fixedly connected to the side portion 27 below the side opening 29 by suitable means such as an adhesive, the side opening 29 being located at a height H above the jaw portion 22. The socket tab 78 extends to a flat pattern distance M from the distance g, the distance M being inclusive of the distances J, K, and L. As best shown in FIG. 4, the fold lines 76*a*, 76*b* and 76*c* for the sockets 26 are preferably more widely spaced apart about the leg portions 42 proximate the arm portions 40*a* and 40*b* of the cranks 36*a* and 36*b* than at the opposite (end) extremities of the leg portions 42 for facilitating entry of the leg portions 42 into the sockets 26. More particularly, the fold lines 76*a*, 76*b* and 76*c* are spaced by distances J', K', and L' proximate the end extremities of the leg portions 26, the distances J', K', and L' being less, respectively, than the corresponding distances J, K, and L proximate the arm portions 40*a* and 40*b* of the cranks 36*a* and 36*b* as shown in FIG. 1.

As further shown most clearly in FIG. 4, the jaw portion 16 also includes opposite pairs of first jaw tabs 80 that extend from respective first tab fold lines 82*a* that extend along side extremities of the side portion 27 of the first jaw member 20*a*. The jaw tabs 80 include respective primary tab portions 80*a* that extend a width d from the first tab fold lines 82*a* to corresponding second tab fold lines 82*b*, secondary tab portions 80*b* that extend another width d to corresponding third tab fold lines 82c, and tertiary tab portions 80c that extend a further distance b, the distance b and the width d corresponding to the distance B and the width d, respectively. Similarly, another pair of the jaw tabs 80, designated 80', extend from the second jaw member 20b, the jaw tabs 80' having corresponding primary, secondary, and tertiary tab portions 80a', 80b', and 80c' that are bounded by first, second, and third tab fold lines 82a', 82b', and 82c'. The jaw tabs 80', being otherwise formed as direct counterparts of the jaw tabs 80, are notched as indicated at 83 for facilitating entry of same between the jaw tabs 80 as the jaw portion 16 is closed. Also, the tertiary jaw tabs 80c' have widths b' that correspond to the distance B' on the side portion 27 of the second jaw member 20b.

As shown in FIG. 1, the primary tabs 80a extend generally orthogonal to the side portions 27 and to the blade members 22 from the first tab fold lines 82a for providing respective end closures of the jaw portion 16, the jaw tabs 80' being in proximate overlapping contact with the jaw tabs 80. More particularly, the primary and secondary tab portions 80a and 80b are folded double along the second tab fold lines 82b for strengthening the jaw tabs 80, the tertiary tab portions being fixably joined to the side portions 27 within the respective distances B and B' for further strengthening the jaw portion 16.

As further shown in FIG. 4, a hinge tab 84 extends from each of the hinge members 28, being joined thereto along the first tab fold lines 82a. Each of the hinge tabs 84 is folded against the corresponding hinge member 28 along the tab fold line 82a, being fixedly joined thereto such as by a suitable adhesive for structurally reinforcing the hinge members 28. Also, a pair of blade tabs 86 extends from each of the second blade portions 22b, the blade tabs 86 of the first jaw member 20a being joined thereto along the first tab fold lines 82a. Similarly, the blade tabs 86 of the second jaw member 20b are joined to the blade portion 22b thereof along the first tab fold lines 82a'. The blade tabs 86 extend approximately orthogonal to the blade members 22, being joined to adjacent ones of the jaw tabs 80 for both sealingly closing the jaw members 20a and 20b between the blade members 22 and the jaw tabs 80 and enhancing the structural integrity of the jaw members 20a and 20b.

The bag portion 18 is preferably formed of a thin, flexible, transparent material, such as polyethylene or the like. The bag material is advantageously thin and flexible for avoiding interference with operation of the jaw members 20a and 20b, and for facilitating transfer of the waste 25 from the jaw portion 16 into the bag portion 18. The bag material is advantageously transparent for permitting visual monitoring of pick-up and transfer operations of the apparatus 10. As shown in FIG. 1, the bag portion 18 can have a rectangular, pleated configuration that is sealingly closed except at an opening edge margin 88, the adhesive strip 19 sealingly connecting the bag portion 18 approximately along the opening edge margin 88 thereof. Thus, the receptacle unit 14 is effectively sealingly closed by the combination of the bag portion 18 and the jaw portion 16.

FIG. 4 is an approximately to-scale drawing of a preferred exemplary configuration of the jaw portion 16, the approximate dimensions thereof being given below in the following Table.

TABLE

Dimensions of Preferred Embodiment

| Dimension | Description | Value (in.) |
|---|---|---|
| A | width of first jaw member | 5.50 |
| A' | width of second jaw member | 5.25 |
| B | distance to opening (first jaw member) | 0.75 |
| B' | distance to opening (second jaw member) | 0.63 |
| C | width of opening | 4.00 |
| D | width of hinge member | 0.75 |
| E | distance (height of first jaw member) | 3.00 |
| E' | distance (height of second jaw member) | 2.88 |
| F | offset of jaw members | 0.13 |
| G | width of blade member | 1.00 |
| H | height of opening | 1.00 |
| J | distance (width of bottom socket wall) | 0.31 |
| J' | distance (reduced J proximate extremity) | 0.19 |
| K | distance (height of side socket wall) | 0.44 |
| K' | distance (reduced K proximate extremity) | 0.31 |
| L | distance (width of top socket wall) | 0.31 |
| L' | distance (reduced L proximate extremity) | 0.19 |
| M | flat pattern distance (of socket tab) | 1.38 |

The present invention thus provides a means for disposing of animal waste that is sanitary, easy to use, and inexpensive to produce. The receptacle units 14 are stackable such that a supply of the receptacle units 14 can be boxed with the sockets 26 of one such unit 14 exposed for engagement by the leg portions 42 of the actuator unit 12. Thus, a fresh receptacle unit 14 can be engaged and lifted from the supply without the user having to actually handle the receptacle units 14. More importantly, a used receptacle unit 14 can be removed from the actuator unit 12 by merely tipping the leg portions 42 downwardly such that the receptacle unit 14 falls into a suitable waste container (not shown). Thus, the user is not required to handle the receptacle units 14 having the waste 25 therein, apparatus 10 being operable at a substantial distance away from the waste 25. Further, the actuator unit 12, including the leg portions 42, is not subject to contamination by the waste 25.

Although the present invention has been described in considerable detail with reference to certain preferred versions thereof, other versions are possible. For example, the opening handle 56 can be non-tubular and slotted for receiving a single one of the stops (58, 60) for limiting both directions of travel of the handle 56, the stop being headed for retaining the handle 56 on the shank member 32. The opening handle 56 can have a corresponding projection for facilitating operation thereof. Also, the actuator cranks can have other configurations, such as an L-shaped configuration. Therefore, the spirit and scope of the appended claims should not necessarily be limited to the description of the preferred versions contained herein.

What is claimed is:

1. Apparatus for handling waste material to be removed from a ground surface, the apparatus comprising in combination:

(a) a receptacle unit comprising:

(i) a jaw portion having first and second jaw members, lower extremities of the respective jaw members having corresponding generally horizontally extending first and second blade portions, one of the jaw members being movable relative to the other jaw member between an open position wherein the jaw members are separated by a jaw opening for receiving the waste material into the receptacle unit, and a closed position wherein the jaw members are in close proximity for forming a jaw cavity, each of the jaw members having an engagement member for actuation thereof;

(ii) a flexible bag member for holding the waste material, the bag member having a bag cavity and a bag opening, the bag opening defining a perimeter margin of the bag member;

(iii) a bag connector for sealingly connecting the bag member to the jaw portion with the bag cavity in fluid communication with the jaw cavity whereby the bag cavity is substantially closed by the jaw members in the closed position thereof for retaining the waste material within the receptacle unit; and (iv) a jaw holder for yieldably holding the jaw members in the closed position; and (b) an actuator unit comprising:

(i) a base handle member;

(ii) a spaced pair of actuator members for supportively connecting the engagement members of the receptacle unit;

(iii) a first actuator for selectively moving at least one of the actuator members for operating the jaw members between the open and closed positions thereof, whereby the apparatus is operable for:

(i) while the jaw members are in the open position, positioning the receptacle unit in substantial contact with the ground surface with the blade portions on opposite sides of the waste material by manipulation of the base handle member;

(ii) moving the jaw members into the closed position whereby waste material is contained within the receptacle unit; and (iii) disconnecting the receptacle unit from the actuator unit without releasing the waste material from the receptacle unit.

2. The apparatus of claim 1, wherein each of the actuator members has a horizontally projecting leg portion, and the engagement members of the jaw portion each form a socket opening for receiving a respective one of the leg portions.

3. The apparatus of claim 2, wherein the actuator members are pivotally connected relative to the base handle member.

4. The apparatus of claim 2, further comprising an actuator holder for biasingly urging the actuator members toward the closed position of the jaw members.

5. The apparatus of claim 4, wherein the actuator holder comprises an elastic band enclosing portions of the actuator members.

6. The apparatus of claim 2, wherein the socket openings extend proximate the blade portions, approximately in parallel relation thereto.

7. The apparatus of claim 1, further comprising a hinge member for hingably connecting the jaw members.

8. The apparatus of claim I, wherein the first actuator comprises:

(a) a first handle member movably supported relative to the base handle member; and (b) a first connector operatively connecting the first handle member to one of the actuator members for movement thereof, the jaw members of the receptacle unit being moved to the open position in response to movement of the first handle member relative to the base handle member.

9. The apparatus of claim 8, wherein the first handle member slidably engages the base handle member, and wherein the first connector comprises a flexible member.

10. The apparatus of claim 1, further comprising a second actuator for orienting the jaw cavity above the bag cavity for transferring the waste material from the jaw cavity into the bag cavity, and a blocker for blocking the waste material from reentering the jaw cavity, whereby the apparatus is further operative for picking up an additional quantity of waste material without losing waste material previously transferred into the bag cavity.

11. The apparatus of claim 10, wherein the blocker comprises a partition member of the jaw portion, the partition member defining a transfer opening between the jaw cavity and the bag cavity.

12. The apparatus of claim 11, wherein the partition member forms a side wall of one of the jaw members.

13. The apparatus of claim 1, wherein the bag connector comprises an adhesive strip.

14. The apparatus of claim 1, wherein the bag member is formed of a transparent material for monitoring operation of the apparatus.

15. The apparatus of claim 1, wherein the jaw holder comprises an elastic band extending between the jaw members.

16. The apparatus of claim 15 wherein the elastic band of the jaw holder is retained by the engagement members of the receptacle unit.

17. The apparatus of claim 16, wherein the elastic band of the jaw holder extends proximate opposite ends of the jaw members.

18. Apparatus for handling waste material to be removed from a ground surface, the apparatus comprising in combination:

(a) a receptacle unit comprising:

(i) a jaw portion having first and second jaw members, lower extremities of the respective jaw members having corresponding generally horizontally extending first and second blade portions, one of the jaw members being movable relative to the other jaw member between an open position wherein the jaw members are separated by a jaw opening for receiving the waste material into the receptacle unit, and a closed position wherein the jaw members are in close proximity for forming a jaw cavity, each of the jaw members having an engagement member for actuation thereof;

(ii) a flexible bag member for holding the waste material, the bag member having a bag cavity and a bag opening, the bag opening defining a perimeter margin of the bag member;

(iii) a bag connector for sealingly connecting the bag member to the jaw portion with the bag cavity in fluid communication with the jaw cavity whereby the bag cavity is substantially closed by the jaw members int he closed position thereof for retaining the waste material within the receptacle unit;

(iv) a blocker for blocking the waste material from moving from the bag member to the jaw cavity; and (v) a jaw holder for yieldably holding the jaw members in the closed position; and (b) an actuator unit comprising:

(i) a base handle member;

(ii) a spaced pair of actuator members for supportively connecting the engagement members of the receptacle unit;

(iii) a first actuator for selectively moving at least one of the actuator members for operating the jaw members between the open and closed positions thereof;

(c) a second actuator for moving the engagement members relative to the base handle member from an approximately horizontally spaced orientation to an approximately vertically spaced orientation while the jaw members remain in the closed position, whereby the apparatus is operable for:

(i) while the jaw members are in the open position, positioning the receptacle unit in substantial contact with the ground surface with the blade portions on opposite sides of the waste material by manipulation of the base handle member;

(ii) moving the jaw members into the closed position whereby waste material is contained within the receptacle unit;

(iii) while the jaw members remain in the closed position, moving the engagement members to the vertically spaced orientation for orienting the jaw cavity above the bag cavity for transferring the waste material from the jaw cavity into the bag cavity;

(iv) disconnecting the receptacle until from the actuator unit without releasing the waste material from the receptacle unit; and (v) picking up an additional quantity of waste material without losing waste material previously transferred into the bag cavity.

19. The apparatus of claim 18, wherein the actuator members are pivotally connected relative to the base handle member, and the second actuator is operative for selectively moving one of the jaw members in a direction displacing the other jaw member.

20. The apparatus of claim 18, wherein the second actuator comprises:

(a) a second handle member movably supported relative to the base handle member between a lock position and a transfer position;

(b) a second connector operatively connecting the second handle member to one of the actuator members for movement thereof, the engagement members of the receptacle unit being moved to the vertically spaced orientation in response to movement of the second handle member relative to the base handle member; and (c) a lock for yieldably holding the second handle member in the lock position wherein the actuator members are releasably maintained in the horizontally spaced orientation.

21. Apparatus for handling waste material to be removed from a ground surface, the apparatus comprising:

(a) a jaw portion having first and second jaw members, a hinge member for hingably connecting the jaw members, lower extremities of the respective jaw members having corresponding generally horizontally extending first and second blade portions, one of the jaw members being movable relative to the other jaw member between an open position wherein the jaw members are separated by a jaw opening for receiving the waste material and a closed position wherein the jaw members are in close proximity for forming a jaw cavity for temporarily holding the waste material, each of the jaw members having an engagement member for actuation thereof;

(b) a flexible bag member for holding the waste material, the bag member having a bag cavity and a bag opening, the bag opening defining a perimeter margin of the bag member;

(c) a bag connector for sealingly connecting the bag member to the jaw portion with the bag cavity in fluid communication with the jaw cavity whereby the bag cavity is substantially closed by the jaw members in the closed position thereof for retaining the waste material;

(d) a jaw holder for yieldably holding the jaw members in the closed position; and (e) a blocker for blocking the waste material from reentering the jaw cavity, the blocker comprising a partition member of the jaw portion, the partition member defining a transfer opening between the jaw cavity and the bag cavity, whereby the apparatus is operable for:

(i) while the jaw members are in the open position, positioning the jaw portion in substantial contact with the ground surface with the blade portions on opposite sides of the waste material by manipulation of the engagement member;

(ii) moving the jaw members into the closed position whereby waste material is contained within the jaw cavity, the jaw members being maintained in the closed position by the jaw holder for retaining the waste material within the apparatus for disposal therewith;

(iii) transferring the waste material from the jaw cavity to the bag cavity by manipulation of the engagement members; and (iv) picking up an additional quantity of waste material without losing waste material previously transferred into the bag cavity.

22. The apparatus of claim 21, wherein the engagement members of the jaw portion each form a socket opening for receiving actuator leg members.

23. The apparatus of claim 22, wherein the socket openings extend proximate the blade portions, approximately in parallel relation thereto.

24. The apparatus of claim 21, wherein the jaw holder comprises an elastic band extending between the jaw members.

25. The apparatus of claim 24, wherein the elastic band of the jaw holder extends proximate opposite ends of the jaw members.

26. Apparatus for handling waste material to be removed from a ground surface, the apparatus comprising in combination:

(a) a receptacle unit comprising:

(i) a jaw portion having first and second jaw members, a spaced pair of hinge members for hingably connecting the jaw members, lower extremities of the respective jaw members having corresponding generally horizontally extending first and second blade portions, one of the jaw members being movable relative to the other jaw member between an open position wherein the jaw members are separated by a jaw opening for receiving the waste material into the receptacle unit, and a closed position wherein the jaw members are in close proximity for forming a jaw cavity, each of the jaw members having an engagement member for actuation thereof;

(ii) a flexible bag member for holding the waste material, the bag member having a bag cavity and a bag opening, the bag opening defining a perimeter margin of the bag member;

(iii) a bag connector for sealingly connecting the bag member to the jaw portion with the bag cavity in fluid communication with the jaw cavity whereby the bag cavity is substantially closed by the jaw members in the closed position thereof for retaining the waste material within the receptacle unit;

(iv) a blocker for blocking the waste material from reentering the jaw cavity, the blocker comprising a partition member of the jaw portion, the partition member defining a transfer opening between the jaw cavity and the bag cavity;

(v) an elastic jaw band extending between the jaw members for yieldably holding the jaw members in the closed position; and (b) an actuator unit comprising:

(i) a base handle member;

(ii) a spaced pair of actuator members for supportively connecting the engagement members of the receptacle unit, each of the actuator members having a horizontally projecting leg portion, the engagement members of the jaw portion each forming a socket opening for receiving a respective one of the leg portions, the socket openings extending proximate the blade portions approximately in parallel relation thereto, the actuator members being pivotally connected relative to the base handle member;

(iii) a first actuator for selectively moving at least one of the actuator members for operating the jaw members between the open and closed positions thereof, the first actuator comprising a first handle member movably supported relative to the base handle member, and a first connector operatively connecting the first handle member to one of the actuator members for movement thereof, the jaw members of the receptacle unit being moved to the open position in response to movement of the first handle member relative to the base handle member;

(iv) a second actuator for orienting the jaw cavity above the bag cavity for transferring the waste material from the jaw cavity into the bag cavity, the second actuator being operative for moving the engagement members relative to the base handle member from an approximately horizontally spaced orientation to an approximately vertically spaced orientation while the jaw members remain in the closed position, the second actuator comprising a second handle member movably supported relative to the base handle member between a lock position and a transfer position, a second connector operatively connecting the second handle member to one of the actuator members for movement thereof, the engagement members of the receptacle unit being moved to the vertically spaced orientation in response to movement of the second handle member relative to the base handle member, and a lock for yieldably holding the second handle member in the lock position wherein the actuator members are releasably maintained in the horizontally spaced orientation;

(v) an actuator holder for biasingly urging the actuator members toward the closed position of the jaw members, whereby the apparatus is operable for:

(i) while the jaw members are in the open position, positioning the receptacle unit in substantial contact with the ground surface with the blade portions on opposite sides of the waste material by manipulation of the base handle member;

(ii) moving the jaw members into the closed position whereby waste material is contained within the receptacle unit;

(iii) picking up an additional quantity of waste material without losing waste material previously transferred into the bag cavity; and (iv) disconnecting the receptacle unit from the actuator unit without releasing the waste material from the receptacle unit.

* * * * *